US008284133B2

(12) United States Patent
Kang et al.

(10) Patent No.: US 8,284,133 B2
(45) Date of Patent: Oct. 9, 2012

(54) LIGHT EMITTING APPARATUS AND CONTROL METHOD THEREOF

(75) Inventors: Jeong-il Kang, Yongin-si (KR); Sang-hoon Lee, Ulsan (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1000 days.

(21) Appl. No.: 11/651,570

(22) Filed: Jan. 10, 2007

(65) Prior Publication Data

US 2007/0195023 A1 Aug. 23, 2007

(30) Foreign Application Priority Data

Feb. 22, 2006 (KR) ..... 10-2006-0017361

(51) Int. Cl.
*G09G 3/32* (2006.01)

(52) U.S. Cl. ..... 345/82; 345/77; 345/691

(58) Field of Classification Search ..... 345/77, 345/88, 102, 204, 691; 362/27, 249.02, 311.02, 362/612

See application file for complete search history.

(56) References Cited

U.S. PATENT DOCUMENTS

| | | | | |
|---|---|---|---|---|
| 6,872,973 | B1 * | 3/2005 | Koyama et al. | 257/59 |
| 7,187,351 | B2 * | 3/2007 | Kwon | 345/82 |
| 2003/0076316 | A1 * | 4/2003 | Kang | 345/212 |
| 2003/0178946 | A1 * | 9/2003 | Nakamura et al. | 315/169.3 |
| 2005/0231459 | A1 * | 10/2005 | Furukawa | 345/102 |
| 2005/0243022 | A1 * | 11/2005 | Negru | 345/46 |

FOREIGN PATENT DOCUMENTS

| | | | |
|---|---|---|---|
| CN | 2870364 | Y | 2/2007 |
| JP | 8-199439 | A | 7/1996 |
| JP | 9-081211 | A | 3/1997 |
| JP | 2003-133924 | A | 5/2003 |
| JP | 2005-234487 | A | 9/2005 |

OTHER PUBLICATIONS

Korean Office Action issued on Aug. 26, 2010 in the corresponding Korean Patent Application No. 10-2006-0017361.

* cited by examiner

*Primary Examiner* — Joe H Cheng
(74) *Attorney, Agent, or Firm* — Sughrue Mion, PLLC

(57) ABSTRACT

A light emitting apparatus includes: a plurality of light emitting parts connected in series; a current supplying part supplying current to the plurality of light emitting parts; a plurality of current switches connected in parallel to the plurality of light emitting parts, respectively, and causing the current to flow through the light emitting parts or bypass the light emitting parts; and a controlling part receiving brightness information corresponding to the plurality of light emitting parts and outputting pulse width modulation signals to the current switches so that emission time of the plurality of light emitting parts is separately adjusted based on the received brightness information.

15 Claims, 7 Drawing Sheets

LIGHT EMITTING APPARATUS AND CONTROL METHOD THEREOF

CROSS-REFERENCE TO RELATED APPLICATIONS

This application claims priority from Korean Patent Application No. 2006-0017361, filed on Feb. 22, 2006, in the Korean Intellectual Property Office, the disclosure of which is incorporated herein by reference.

BACKGROUND OF THE INVENTION

1. Field of the Invention

Methods and apparatuses consistent with the present invention relate to a light emitting apparatus and a control method thereof, and more particularly, to a light emitting apparatus, which is capable of separately controlling luminescence of a plurality of light emitting parts with a variety of gray scales, and a control method thereof.

2. Description of the Related Art

A light emitting apparatus includes a plurality of light emitting parts such as an array of light emitting diodes (LEDs) arranged in the form of a matrix, and a display such as a liquid crystal display (LCD) panel. The plurality of light emitting parts functions as a light source to allow an image to be displayed on the display.

FIGS. 5A and 5B are views showing examples of a conventional light emitting apparatus. As shown in FIG. 5A, the conventional light emitting apparatus includes 9 LEDs 10*a* to 10*c*, 20*a* to 20*c*, and 30*a* to 30*c* arranged in the form of a 3×3 matrix, and driving circuits 11*a* to 11*c*, 21*a* to 21*c*, and 31*a* to 31*c* for controlling the 9 LEDs 10*a* to 10*c*, 20*a* to 20*c*, and 30*a* to 30*c*, respectively. The light emitting apparatus can control the luminescence of the 9 LEDs 10*a* to 10*c*, 20*a* to 20*c*, and 30*a* to 30*c* sequentially by the driving circuits 11*a* to 11*c*, 21*a* to 21*c*, and 31*a* to 31*c*. The 9 LEDs 10*a* to 10*c*, 20*a* to 20*c*, and 30*a* to 30*c* may be monochromatic, or may represent a variety of colors in combination of LEDs of several colors.

The driving circuits 11*a* to 11*c*, 21*a* to 21*c*, and 31*a* to 31*c*, which are respectively assigned to the 9 LEDs 10*a* to 10*c*, 20*a* to 20*c*, and 30*a* to 30*c*, are applied with respective independent signals, and accordingly, the 9 LEDs 10*a* to 10*c*, 20*a* to 20*c*, and 30*a* to 30*c* emit light separately. Accordingly, in the light emitting apparatus, the LEDs 10*a* to 10*c*, 20*a* to 20*c*, and 30*a* to 30*c* can emit light with a certain luminescence to display a desired image on a display.

However, in the above-configured light emitting apparatus, the number of driving circuits and the number of driving signals increase as the number of LEDs increase. Therefore, if the LEDs are arranged with uniform density, as the area increases, the number of driving circuits and the number of driving signals may increase by geometric progression in proportion to the square of the area, which may make the light emitting apparatus impractical to use.

As another example, as shown in FIG. 5B, the light emitting apparatus may include 9 LEDs 12*a* to 12*c*, 22*a* to 22*c*, and 32*a* to 32*c* arranged in the form of a 3×3 matrix, three driving circuits 13*a* to 13*c* for controlling columns of the 9 LEDs 12*a* to 12*c*, 22*a* to 22*c*, and 32*a* to 32*c*, respectively, and three switches 14, 24 and 34 for controlling rows of the 9 LEDs 12*a* to 12*c*, 22*a* to 22*c*, and 32*a* to 32*c*, respectively.

In the light emitting apparatus, the three switches 14, 24 and 34 are sequentially turned on at a certain interval, and accordingly, a driving current is applied to the 9 LEDs 12*a* to 12*c*, 22*a* to 22*c*, or 32*a* to 32*c* at a turned-on row, thus emitting light therefrom. After the LEDs 32*a* to 32*c* at the last row emit light, the LEDs 12*a* to 12*c* at the first row emit light again. In this case, when the LEDs at each row are sequentially driven at a very high speed, it appears to a user that the LEDs are simultaneously driven with different luminescence since the user does not perceive fast variation of light but average luminescence (hereinafter referred also to as "brightness") of varying light.

The light emitting apparatus as configured above has an advantage of simplicity of circuit configuration in that it requires only the number of driving circuits and driving signals corresponding to the number of LEDs in one row. However, with such configuration, since the LEDs corresponding to only one row emit light every moment, the use efficiency of the LEDs is low, that is, the maximum luminescence of the overall array of LEDs, which is perceivable by the user, is obtained by dividing the maximum luminescence of one LED by the number of rows. In order to overcome such a disadvantage, there may be a method of providing two or more groups of switches and driving LEDs belonging to each group simultaneously. However, this method also has a problem in that the number of driving circuits and the number of driving signals increase as the number of groups of switches increase.

SUMMARY OF THE INVENTION

Accordingly, it is an aspect of the present invention to provide a light emitting apparatus with a simplified circuit configuration and with high efficiency, which is capable of driving a plurality of light emitting parts so that the plurality of light emitting parts emit light separately with a variety of luminescence.

The foregoing and/or other aspects of the present invention can be achieved by providing a light emitting apparatus including: a plurality of light emitting parts connected in series; a current supplying part which supplies current to the plurality of light emitting parts; a plurality of current switches connected in parallel to the plurality of light emitting parts, respectively, and causing the current to flow through the light emitting parts or bypass the light emitting parts; and a controlling part which receives brightness information corresponding to the plurality of light emitting parts and outputting pulse width modulation signals to the current switches so that emission time of the plurality of light emitting parts is separately adjusted based on the received brightness information.

According to an aspect of the invention, the current switches include bypass transistors connected in parallel to the light emitting parts, respectively, for causing the current supplied from the current supplying part to bypass the light emitting parts.

According to an aspect of the invention, the current switches include capacitors connected to the bypass transistors, respectively, and charged with a certain voltage, and the controlling part outputs control signals to turn on the bypass transistors when the capacitors are charged.

According to an aspect of the invention, the light emitting apparatus include a voltage supplying part which supplies a voltage to the capacitors, the controlling part includes a capacitor controller for controlling the capacitors to be charged with the certain voltage.

According to an aspect of the invention, the voltage supplying part is connected to first ends of the capacitors and the capacitor controller is connected to second ends of the capacitors, and the capacitor controller determines whether the voltage output from the voltage supplying part is supplied to the first ends of the capacitors in order to control charging of the capacitors.

According to an aspect of the invention, the controlling part controls the capacitors to be charged with a certain voltage when all of the plurality of light emitting parts are lighted down.

According to an aspect of the invention, the current switches include turn-on voltage transmitting parts which supply a turn-on voltage to the bypass transistors according to the control signals from the controlling part in the state where the capacitors are charged.

According to an aspect of the invention, each of the turn-on voltage transmitting parts include at least one of a photo-coupler and a side gate driver.

According to an aspect of the invention, each of the plurality of light emitting parts include at least one LED (light emitting diode).

According to an aspect of the invention, the light emitting apparatus includes a display for receiving light emitted from the light emitting parts and displaying an image.

The foregoing and/or other aspects of the present invention can be achieved by providing a method of controlling a light emitting apparatus, including: receiving brightness information corresponding to a plurality of light emitting parts connected in series; supplying current to the plurality of light emitting parts; outputting pulse width modulation signals so that emission time of the plurality of light emitting parts is separately adjusted based on the received brightness information; and causing the current to flow through the light emitting parts or bypass the light emitting parts according to the pulse width modulation signal.

According to an aspect of the invention, causing the current to flow through the light emitting parts or bypass the light emitting parts includes switching the flow of the current so that the current flows through the light emitting parts or bypasses the light emitting parts according to the pulse width modulation signal.

According to an aspect of the invention, causing the current to flow through the light emitting parts or bypass the light emitting parts includes switching flow of the current by a voltage signal different from the pulse width modulation signal according to the pulse width modulation signal.

BRIEF DESCRIPTION OF THE DRAWINGS

The above and/or other aspects and advantages of the present invention will become apparent and more readily appreciated from the following description of the exemplary embodiments, taken in conjunction with the accompanying drawings of which.

DETAILED DESCRIPTION OF THE EXEMPLARY EMBODIMENTS OF THE INVENTION

Reference will now be made in detail to exemplary embodiments of the present invention, examples of which are illustrated in the accompanying drawings.

Figure 1:
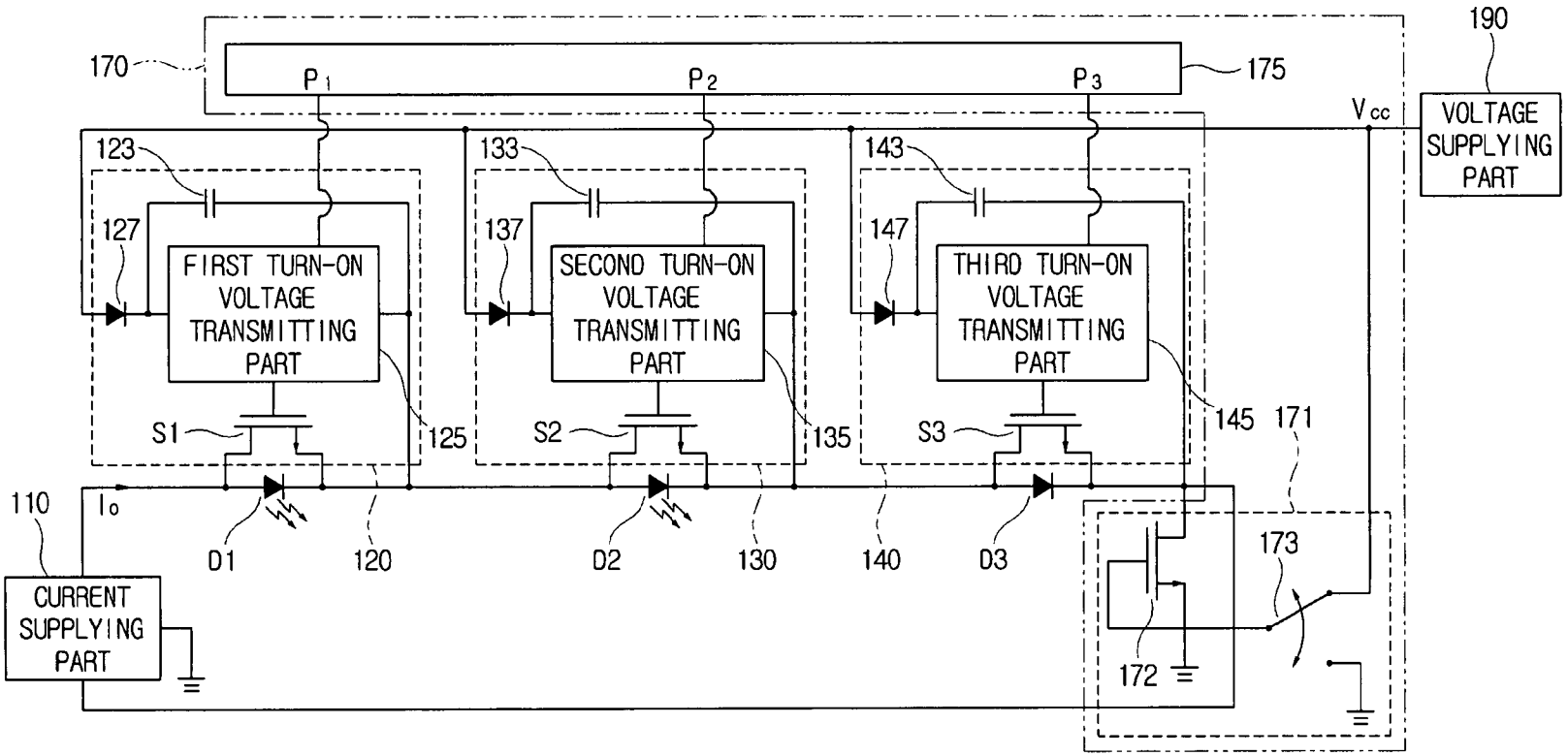
FIG. 1 is a schematic view illustrating configuration of a light emitting apparatus according to an exemplary embodiment of the present invention.

Referring to FIG. 1, a light emitting apparatus of the present invention includes a plurality of light emitting parts D1, D2, and D3, a current supplying part 110 for supplying current to the light emitting parts D1, D2, and D3, a plurality of current switches 120, 130, and 140 provided in correspondence to the light emitting parts D1, D2, and D3, and a controlling part 170 for controlling these components. In addition, the light emitting apparatus may include a voltage supplying part 190 for supplying a voltage to the current switches 120, 130, and 140.

FIG. 1 shows the light emitting apparatus including three light emitting parts D1, D2, and D3 and three current switches 120, 130, and 140. However, this is only by way of example, and the number of light emitting parts D1, D2, and D3 is not limited, as long as the light emitting apparatus includes at least one light emitting part. As shown in FIG. 1, the light emitting apparatus includes the current supplying part 110 and the plurality of light emitting parts D1, D2, and D3 for emitting light according to current Io supplied from the current supplying part 110, and the controlling part 170 may control the current supplying part 110 and the light emitting parts D1, D2, and D3 based on information on brightness of the light emitting parts D1, D2, and D3.

It is preferable but not necessary that the current supplying part 110, which is a current source which supplies the current Io to the light emitting parts D1, D2, and D3, supplies a constant current Io to adjust and maintain the brightness of the light emitting parts D1, D2, and D3.

The light emitting parts D1, D2, and D3 provide light to a display (not shown) on which an image is displayed. In this exemplary embodiment, it is preferable but not necessary that the light emitting parts D1, D2, and D3 include light emitting diodes (LEDs). In this exemplary embodiment, the LEDs include a red LED for emitting red light, a green LED for emitting green light, and a blue LED for emitting blue light, and may include other various LEDs such as a cyan LED for emitting cyan light, a yellow LED for emitting yellow light, a magenta LED for emitting magenta light, and a white LED for emitting white light.

The plurality of current switches 120, 130, and 140 provided in correspondence to the light emitting parts D1, D2, and D3 are connected in parallel to the light emitting parts D1, D2, and D3, respectively. The current switches 120, 130, and 140 connected respectively to the light emitting parts D1, D2, and D3 are turned on and off, under control of the controlling part 170, so that the current Io flows through the light emitting parts D1, D2, and D3 or bypasses the light emitting parts D1, D2, and D3 and not flow therethrough.

The current switches 120, 130, and 140 may include at least one of bypass transistors S1, S2, and S3, turn-on voltage transmitting parts 125, 135, and 145, capacitors 123, 133, and 143, and diodes 127, 137, and 147, respectively.

The bypass transistors S1, S2, and S3 are connected in parallel to the light emitting parts D1, D2, and D3, respectively, for switching the current Io to be applied to the light emitting parts D1, D2, and D3. In this exemplary embodiment, it is preferable but not necessary that the bypass transistors S1, S2, and S3 are MOSFETs. It is sufficient if the bypass transistors S1, S2, and S3 are FET devices or the like for switching the flow of the current Io. Hereinafter, MOSFETs are used as the bypass transistors where S1, S2, and S3 are illustrated.

The turn-on voltage transmitting parts 125, 135 and 145 apply a turn-on voltage to the bypass transistors S1, S2 and S3 in response to driving control signals P1, P2 and P3 from the controlling part 170 in the state where the capacitors 123, 133 and 143 are charged. In this exemplary embodiment, the turn-on voltage transmitting parts 125, 135, and 145 may include photo-couplers, high side gate drivers, etc. In addition, the turn-on voltage transmitting parts 125, 135, and 145 are configured to allow the bypass transistors S1, S2 and S3 to be driven with driving signals having a reference level different from the sources of the bypass transistors S1, S2 and S3.

The controlling part 170 receives information on brightness corresponding to the plurality of light emitting parts D1, D2 and D3. Then, the controlling part 170 outputs pulse width modulation signals to the current switches 120, 130 and 140 to adjust emission time of the light emitting parts D1, D2 and D3 separately based on the input brightness information. The pulse width modulation signals correspond to the above-mentioned driving control signals P1, P2 and P3. In this exemplary embodiment, the controlling part 170 controls the light emitting parts D1, D2 and D3 separately by outputting the pulse width modulation signals to the light emitting parts D1, D2 and D3 separately. Accordingly, the controlling part 170 can control a light emission period of each of the light emitting parts D1, D2 and D3 and emission duration in the light emission period separately.

The controlling part 170 controls the voltage supplying part 190 to supply a voltage to the capacitors 123, 133 and 143 and charge them with the voltage, and controls the turn-on voltage transmitting parts 125, 135 and 145 so that the voltage charged in the capacitors 123, 133 and 143 are supplied, as a turn-on voltage, to the bypass transistors S1, S2 and S3.

In this exemplary embodiment, the controller includes a capacitor controller 171 for controlling the capacitors 123, 133 and 143 to be charged, and a main controller 175 for controlling other parts. Specifically, the main controller 175 outputs the driving control signals P1, P2 and P3 to the turn-on voltage transmitting parts 125, 135 and 145, respectively, and may control the magnitude of the current Io supplied from the current supplying part 110 and the magnitude of the voltage supplied from the voltage supplying part 190, as necessary.

The capacitor controller 171 controls the capacitors 123, 133 and 143 to be charged by a voltage supplied thereto. In this exemplary embodiment, the capacitor controller 171 may include a switching element to be turned on and off to determine whether or not the voltage output from the voltage supplying part 190 is supplied to the capacitors 123, 133 and 143.

As shown in FIG. 1, according to an exemplary embodiment of the present invention, the capacitor controller 171 includes a first switch 172 and a second switch 173. In this exemplary embodiment, the second switch 173 has a first end connected to the first switch 172 and a second end connected to the voltage supplying part 190 or a ground. Accordingly, the second switch 173 is turned on and off under control of the main controller 175 so that the voltage Vcc supplied from the voltage supplying part 190 or a ground voltage Vg is supplied to the first switch 172. That is, the second switch 173 is turned on and off according to the voltage Vcc supplied from the voltage supplying part 190 or the ground voltage Vg. When the second end of the second switch 173 is connected to the voltage supplying part 190 and accordingly a high level signal (i.e., the voltage Vcc) is applied to the second switch 173, the second switch 173 is turned on, thus allowing a ground voltage to be supplied to one end of the capacitors 123, 133 and 143. In this exemplary embodiment, it is preferable but not necessary that the ground voltage supplied to the one ends of the capacitors 123, 133 and 143 is a voltage having the same level as the ground voltage Vg supplied to the second switch 173.

As mentioned above, the current supplying part 110 may supply the current Io to the light emitting parts D1, D2 and D3. In this case, when the current Io is applied from the current supplying part 110 to the light emitting parts D1, D2 and D3, the light emitting parts D1, D2 and D3 emit light, i.e., are lighted up. On the contrary, when the current Io is not applied from the current supplying part 110 to the light emitting parts D1, D2 and D3 but flows through the bypass transistors S1, S2 and S3, the light emitting parts D1, D2 and D3 do not emit light, i.e., are lighted down.

Here, when the second end of the second switch 173 of the capacitor controller 171 is connected to the voltage supplying part 190 under control of the main controller 175, thereby allowing the voltage Vcc to be applied to the first switch 172, the first switch 172 is turned on according to the voltage Vcc. Then, the ground voltage is supplied to one end of the third capacitor 143 and the voltage from the voltage supplying part 190 is supplied to other end of the third capacitor 143. In the figure, it is shown that the voltage from the voltage supplying part 190 is supplied to the capacitors 123, 133 and 143 via the diodes 127, 137 and 147 to prevent a current from flowing in the reverse direction.

As described above, the turn-on voltage transmitting parts 125, 135 and 145 transmit turn-on voltages according to the driving control signals P1, P2 and P3 to the bypass transistors S1, S2 and S3. Each of the driving control signals P1, P2 and P3 has a reference level voltage different from a source voltage of the bypass transistors S1, S2 and S3.

Figure 2:
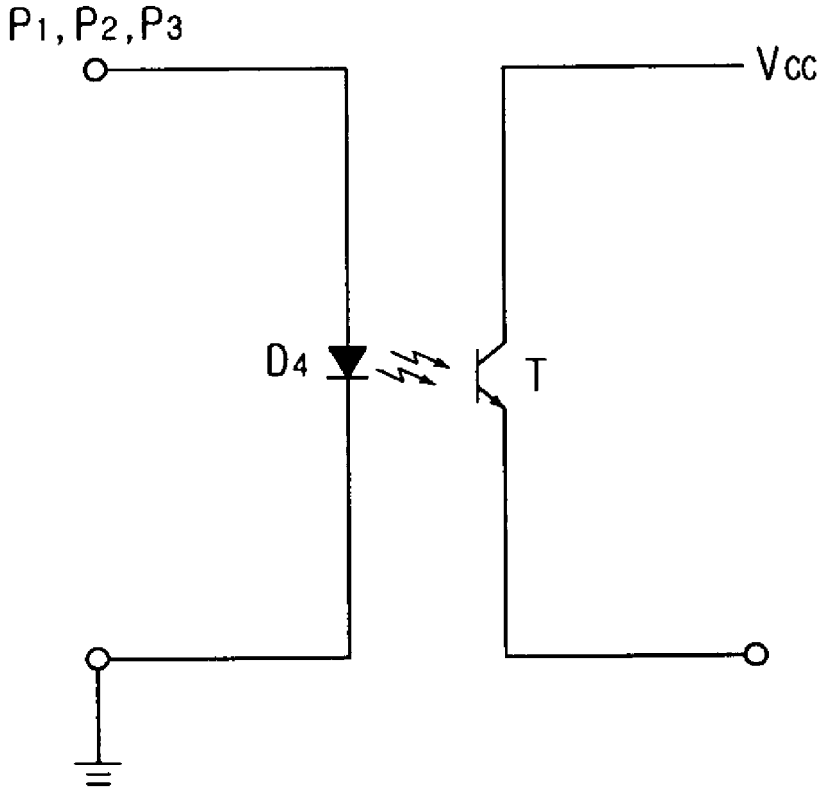
FIG. 2 is a schematic circuit diagram of a photo-coupler included in a turn-on voltage transmitting part of the light emitting apparatus according to an exemplary embodiment of the present invention.

FIG. 2 shows a photo-coupler included in each of the turn-on voltage transmitting parts 125, 135 and 145, the photo-coupler includes a diode D4 and a transistor T. Referring to FIG. 2, the voltage Vcc from the voltage supplying part 190 is supplied to a gate of the third bypass transistor S3. Then, the third capacitor 143 is charged with the voltage Vcc. The charged third capacitor 143 plays a role of a power source for the third turn-on voltage transmitting part 145.

When the driving control signal P3 is applied from the main controller 175 to the third turn-on voltage transmitting part 145, the third capacitor 143 transmits a charging voltage as the power source to the third turn-on voltage transmitting part 145, thereby allowing the third turn-on voltage transmitting part 145 to be driven. Accordingly, the third bypass transistor S3 is turned on, and then, the current Io to be applied to the third light emitting part D3 bypasses the third light emitting part D3 and flows through the third bypass transistor S3.

Similarly, when the driving control signals P1 and P2 are applied from the main controller 175 to the first and second turn-on voltage transmitting parts 125 and 135, respectively, if the first capacitor 123 and the second capacitor 133 have already been charged, the first bypass transistor S1 and the second bypass transistor S2 are turned on, and then, the current Io output from the current supplying part 110 flows through the first bypass transistor S1 and the second bypass transistor S2.

As described earlier, the controlling part 170 outputs the pulse width modulation signals as the driving control signals P1, P2 and P3. In this case, the controlling part 170 may cause the capacitors 123, 133 and 143 to be charged at an intermediate point as well as a beginning point and an end point in a period of dimming of the pulse width modulation signals. At this time, the controlling part 170 may set a short interval during which all of the light emitting parts D1, D2 and D3 are lighted down, and disable the current supplying part 110 in the set interval. In addition, the controlling part 170 may cause the voltage Vcc to be supplied to the second end of the second switch 173 connected to the voltage supplying part 190, and cause the bootstrap capacitors 123, 133 and 143 to be charged by turning on all of the driving control signals P1, P2 and P3.

Here, if the current supplying part 110 takes a ground as a reference potential, it should be understood that an output terminal of the third light emitting part D3 remains in a ground state, and accordingly, the controlling part 170 disables only the current supplying part 110 and causes the bootstrap capacitors 123, 133 and 143 to be charged by turning on all of the driving control signals P1, P2 and P3.

Figure 3A:
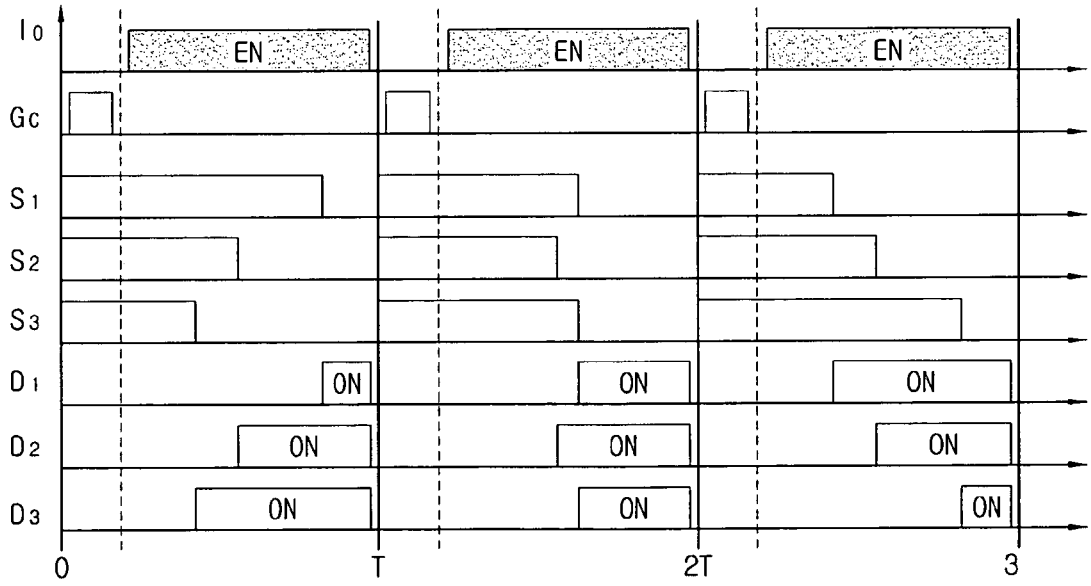
FIGS. 3A and 3B are diagrams illustrating an emission state of light emitting parts according to current supplied from a current supplying part, a charge state of capacitors, and a turn-on state of bypass transistors.
Figure 3B:
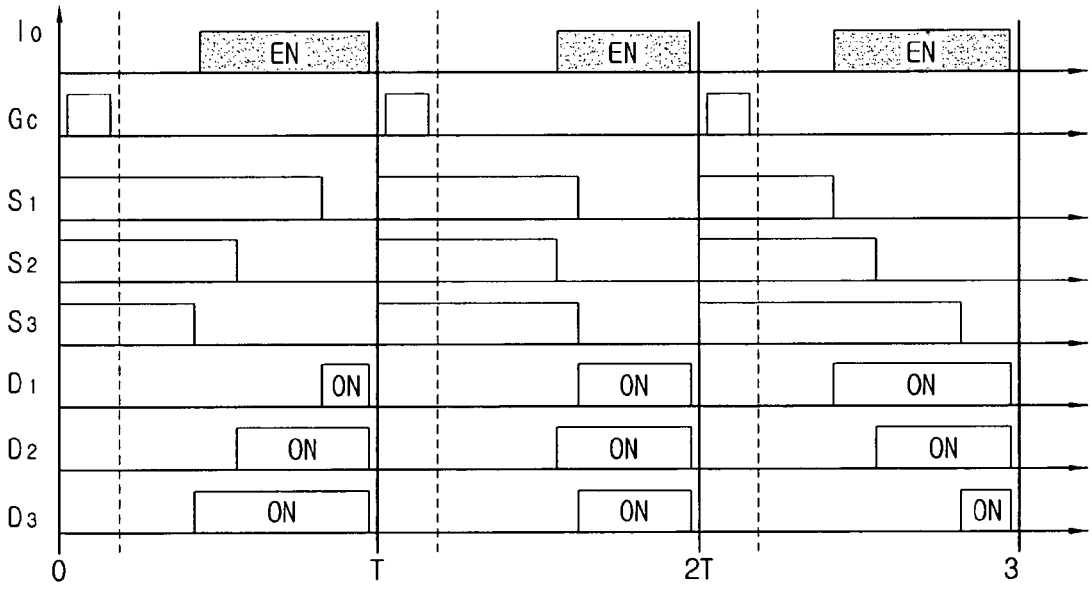

FIGS. 3A and 3B are diagrams illustrating a state of emission of the light emitting parts D1, D2 and D3 according to the current Io supplied from the current supplying part 110, a charge state Gc of the capacitors 123, 133 and 143, and a turn-on state of the bypass transistors S1, S2, and S3 in the light emitting apparatus of the present invention.

FIG. 3A shows that the capacitors 123, 133 and 143 are charged at an initial point of a period T of dimming of the pulse width modulation signals, falling edges of the current Io flowing through the light emitting parts D1, D2 and D3 are synchronized, and rising edges thereof are varied. In the state where the capacitors 123, 133 and 143 are charged so, the current Io flows from the current supplying part 110 through the light emitting parts D1, D2 and D3 in a turn-off state where the current Io does not flow through the bypass transistors S1, S2 and S3. At this time, as shown in FIG. 3A, the first light emitting part D1 is lighted up to emit light in the state where the first bypass transistor S1 is turned off, the second light emitting part D2 is lighted up to emit light in the state where the second bypass transistor S2 is turned off, and the third light emitting part D3 is lighted up to emit light in the state where the third bypass transistor S3 is turned off.

In this case, when the current supplying part 110 supplies the current Io in the state where all of the first to third bypass transistors S1, S2 and S3 are turned on, an output of the current supplying part 110 simulates being short-circuited.

FIG. 3B shows an operation principle of the light emitting parts D1, D2 and D3 that is similar to that illustrated in FIG. 3A, except FIG. 3A shows that the current supplying part 110 supplies the current Io in the state where all of the bypass transistors S1, S2 and S3 are turned on. FIG. 3B shows that the current supplying part 110 is enabled immediately after one of the bypass transistors S1, S2 and S3 is first turned off, and thereafter, the current supplying part 110 supplies the current Io to the light emitting parts D1, D2 and D3.

Although it is illustrated in this exemplary embodiment that the falling edges of the current Io applied to the light emitting parts D1, D2 and D3 are synchronized, the rising edges of the current Io may be synchronized, or controlled in a sequence without any synchronization.

As illustrated in FIGS. 3A and 3B, the first light emitting part D1 become brighter as its turning-on time, i.e., emission time, becomes lengthened, the second light emitting part D2 remains its brightness constant as its emission time remains unchanged, and the third light emitting part D3 become darker as its emission time becomes shortened.

Now, a control flow chart illustrating operation of the light emitting apparatus according to the exemplary embodiment of the present invention will be described with reference to FIG. 4.

First, it is assumed that the light emitting apparatus of the present invention has the plurality of light emitting parts D1, D2 and D3 interconnected in series.

Figure 4:
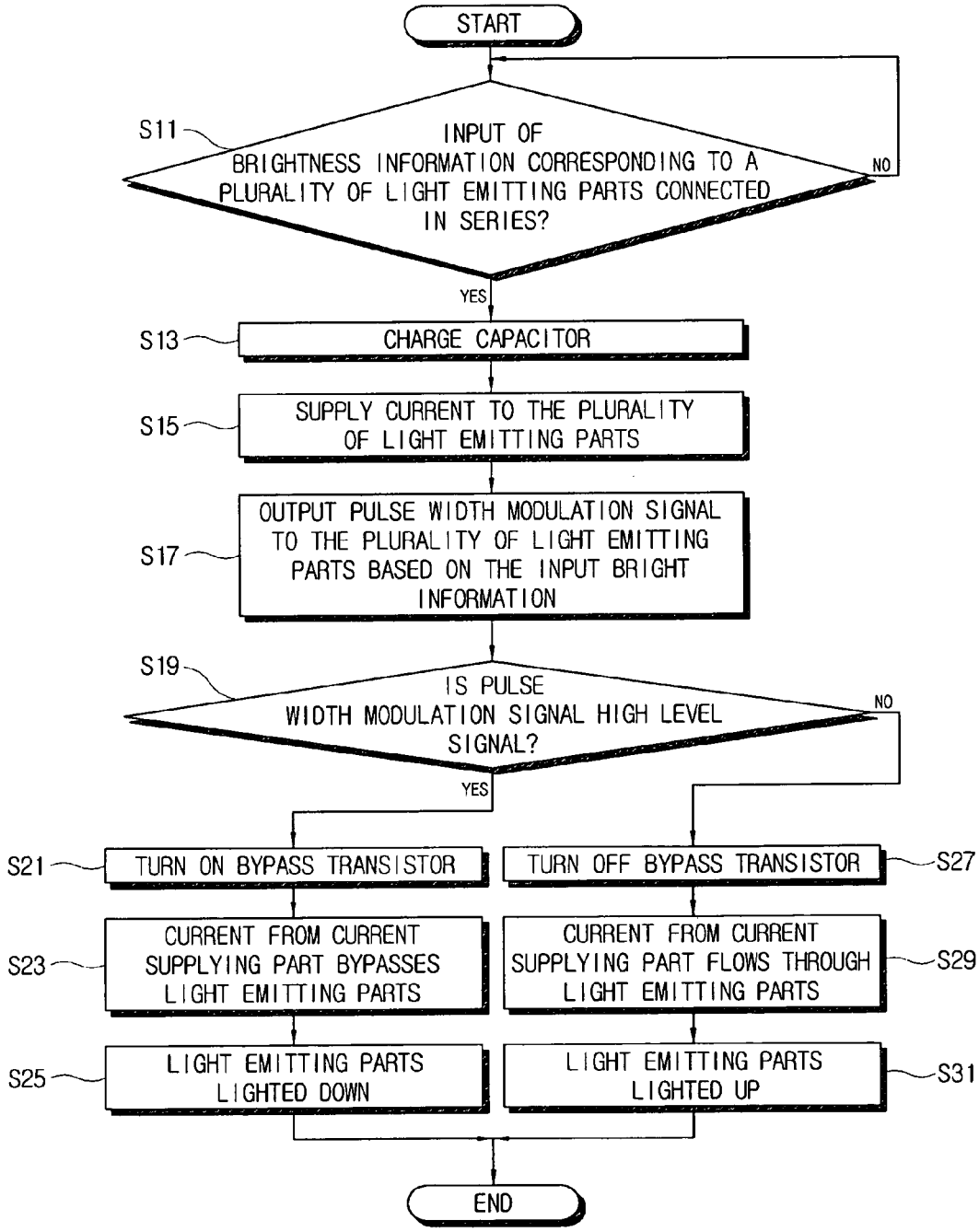
FIG. 4 is a control flowchart illustrating operation of the light emitting apparatus according to an exemplary embodiment of the present invention.
Figure 5A:
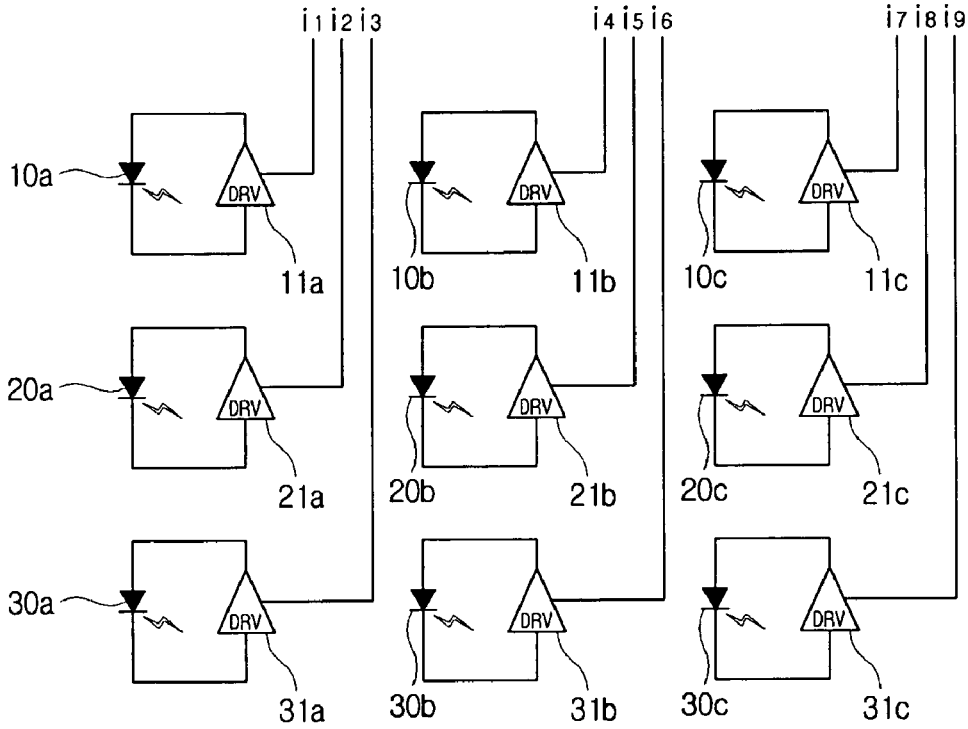
FIGS. 5A and 5B are views showing examples of a conventional light emitting apparatus.
Figure 5B:
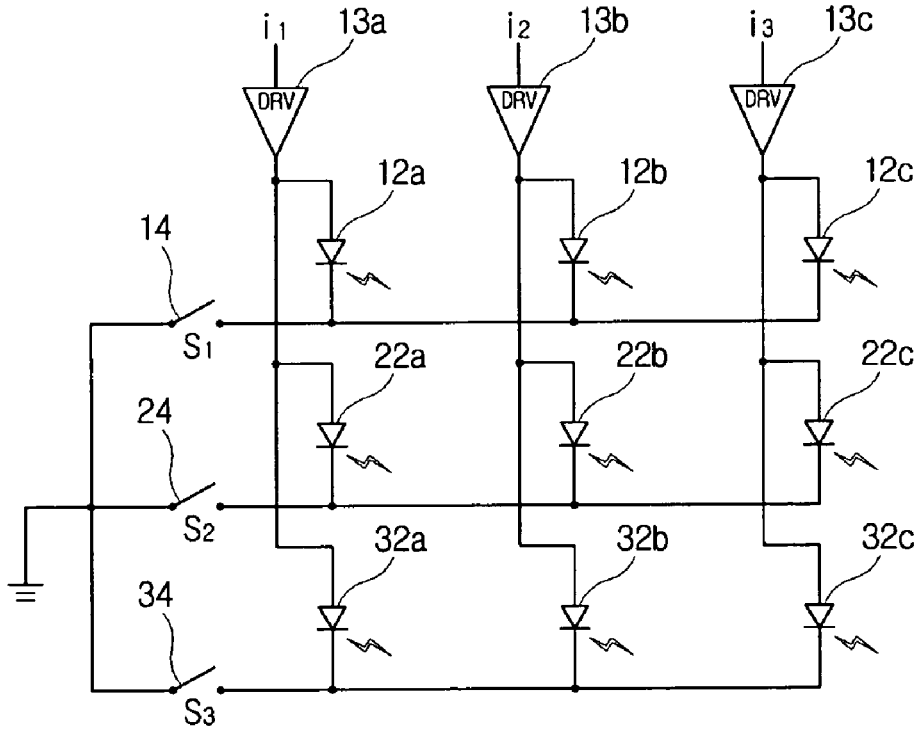

Referring to FIG. 4, the main controller 175 receives brightness information corresponding to the light emitting parts D1, D2 and D3 at operation S11. Then, after disabling the current supplying part 110, the main controller 175 controls the capacitor controller 171 to charge the capacitors 123, 133 and 143 with a voltage at operation S13. In this case, it is preferable but not necessary that operation of charging the capacitors 123, 133 and 143 is performed between operation S11 and operation S15, which will be described later.

Next, the current supplying part 110 supplies the current Io to the light emitting parts D1, D2 and D3 under control of the controlling part 170 at operation S15. Then, the main controller 175 outputs the pulse width modulation signals to the current switches 120, 130 and 140 in order to adjust the emission time of the light emitting parts D1, D2 and D3 based on the input brightness information at operation S17.

Hereinafter, the operation of the current switches 120, 130 and 140 based on the pulse width modulation signals will be briefly described. The pulse width modulation signals, as light emission driving signals of the light emitting parts D1, D2 and D3, are applied from the controller 170 to the current switches 120, 130 and 140. At this time, if the pulse width modulation signals are high level signals at operation S19, the bypass transistors S1, S2 and S3 are turned on if the capacitors 123, 133 and 143 are charged at operation S21. Then, the current Io supplied from the current supplying part 110 bypasses the light emitting parts D1, D2 and D3 and flows through the bypass transistors S1, S2 and S3 at operation S23. Thus, the current Io does not flow through the light emitting parts D1, D2 and D3, that is, the light emitting parts D1, D2 and D3 are lighted down at operation S25.

On the other hand, if the pulse width modulation signals are low level signals at operation S19, the bypass transistors S1, S2 and S3 are turned off at operation S27. Then, the current Io supplied from the current supplying part 110 is applied to the light emitting parts D1, D2 and D3 at operation S29, that is, the light emitting parts D1, D2 and D3 are lighted up to emit light at operation S31.

In the mean time, the light emitting apparatus of the present invention may further include a display for receiving light emitted from the light emitting parts D1, D2 and D3 and displaying an image thereon. The display may include an LCD panel, a PDP, a panel for displaying an image produced according to a projection system, or etc.

Although it is illustrated in the above exemplary embodiment that the bypass transistors S1, S2 and S3 are turned on if the pulse width modulation signals are the high level signals and the bypass transistors S1, S2 and S3 are turned off if the pulse width modulation signals are the low level signals, this is only by way of example and it should be understood that the light emitting apparatus of the present invention may be designed to operate the bypass transistors S1, S2 and S3 in a reverse fashion. In addition, although it is illustrated in the above exemplary embodiment that the ground voltage is supplied to the capacitors 123, 133 and 143 when the voltage from the voltage supplying part 190 is supplied to the first switch 172, it should be understood that the light emitting apparatus of the present invention may be designed so that the ground voltage is supplied to the capacitors 123, 133 and 143 when the voltage from the voltage supplying part 190 is not supplied to the first switch 172.

In the above exemplary embodiment, the capacitors play a role of a power source for the turn-on voltage transmitting parts, and, when the capacitors are charged and the controller applies the driving control signals to the turn-on voltage transmitting parts, the bypass transistors are turned on/off according to the driving control signals. Accordingly, since the emission time of the light emitting parts may be changed according to the driving control signals after the capacitors are charged with the same voltage, the emission time of the light emitting parts may be separately adjusted.

As apparent from the above description, the present invention provides a light emitting apparatus with simplified circuit configuration and with high efficiency, which is capable of driving a plurality of light emitting parts so that the plurality of light emitting parts emit light separately with a variety of brightness.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A light emitting apparatus comprising:

a plurality of light emitting parts connected in series;

a current supplying part which supplies current to the plurality of light emitting parts;

a plurality of switches connected in parallel to the plurality of light emitting parts, respectively, and causing the current to flow through the light emitting parts or bypass the light emitting parts;

a controlling part which receives brightness information corresponding to the plurality of light emitting parts and outputs pulse width modulation signals to the switches so that emission time of the plurality of light emitting parts is separately adjusted based on the received brightness information; and a plurality of bootstrap capacitors selectively connected to the plurality of switches, respectively, wherein respective connections between the plurality of the bootstrap capacitors and the plurality of the switches are controlled based on the pulse width modulation signals output to the plurality of the switches by the controlling part;

wherein the controlling part comprises a capacitor controller which controls the bootstrap capacitors to be charged with a certain voltage, wherein the controlling part supplies the certain voltage of at least one of the plurality of the bootstrap capacitors to turn on a corresponding switch among the plurality of the switches when the at least one of the plurality of the bootstrap capacitors is selectively connected to the corresponding switch based on a pulse width modulation signal, from among the pulse with modulation signals, output to the corresponding switch from the controlling part.

2. The light emitting apparatus according to claim 1, wherein the switches comprise bypass transistors connected in parallel to the light emitting parts, respectively, for causing the current supplied from the current supplying part to bypass the light emitting parts.

3. The light emitting apparatus according to claim 2, further comprising a voltage supplying part supplying a voltage to the bootstrap capacitors.

4. The light emitting apparatus according to claim 1, wherein each of the plurality of light emitting parts comprises at least one LED (light emitting diode).

5. The light emitting apparatus according to claim 4, further comprising a display for receiving light emitted from the light emitting parts and displaying an image.

6. A light emitting apparatus comprising:

a plurality of light emitting parts connected in series;

a current supplying part which supplies current to the plurality of light emitting parts;

a plurality of current switches connected in parallel to the plurality of light emitting parts, respectively, and causing the current to flow through the light emitting parts or bypass the light emitting parts; and a controlling part which receives brightness information corresponding to the plurality of light emitting parts and outputs pulse width modulation signals to the current switches so that emission time of the plurality of light emitting parts is separately adjusted based on the received brightness information, wherein the current switches comprise bypass transistors connected in parallel to the light emitting parts, respectively, for causing the current supplied from the current supplying part to bypass the light emitting parts, wherein the current switches further comprise capacitors connected to the bypass transistors, respectively, and charged with a certain voltage, and the controlling part outputs control signals to turn on the bypass transistors when the capacitors are charged, and the light emitting apparatus further comprises:

a voltage supplying part which supplies a voltage to the capacitors, and the controlling part comprises a capacitor controller for controlling the capacitors to be charged with the certain voltage, wherein the voltage supplying part is connected to first ends of the capacitors and the capacitor controller is connected to second ends of the capacitors, and the capacitor controller determines whether the voltage output from the voltage supplying part is supplied to the first ends of the capacitors in order to control charging of the capacitors.

7. The light emitting apparatus according to claim 6, wherein the current switches comprise turn-on voltage transmitting parts which supply a turn-on voltage to the bypass transistors according to the control signals from the controlling part in a state where the capacitors are charged.

8. A light emitting apparatus comprising:

a plurality of light emitting parts connected in series;

a current supplying part which supplies current to the plurality of light emitting parts;

a plurality of current switches connected in parallel to the plurality of light emitting parts, respectively, and causing the current to flow through the light emitting parts or bypass the light emitting parts; and a controlling part which receives brightness information corresponding to the plurality of light emitting parts and outputs pulse width modulation signals to the current switches so that emission time of the plurality of light emitting parts is separately adjusted based on the received brightness information, wherein the current switches comprise bypass transistors connected in parallel to the light emitting parts, respectively, for causing the current supplied from the current supplying part to bypass the light emitting parts, wherein the current switches further comprise capacitors connected to the bypass transistors, respectively, and charged with a certain voltage, and the controlling part outputs control signals to turn on the bypass transistors when the capacitors are charged, and the light emitting apparatus further comprises:

a voltage supplying part which supplies a voltage to the capacitors, and the controlling part comprises a capacitor controller for controlling the capacitors to be charged with the certain voltage, wherein the voltage supplying part is connected to first ends of the capacitors and the capacitor controller is connected to second ends of the capacitors, and the capacitor controller determines whether the voltage output from the voltage supplying part is supplied to the first ends of the capacitors in order to control charging of the capacitors, wherein the controlling part controls the capacitors to be charged with the certain voltage, when all of the plurality of light emitting parts are lighted down.

9. The light emitting apparatus according to claim 8, wherein the current switches comprise turn-on voltage transmitting parts supplying a turn-on voltage to the bypass transistors according to the control signals from the controlling part in the state where the capacitors are charged.

10. The light emitting apparatus according to claim 9, wherein each of the turn-on voltage transmitting parts comprises at least one of a photo-coupler and a side gate driver.

11. A light emitting apparatus comprising:

a plurality of light emitting parts connected in series;

a current supplying part which supplies current to the plurality of light emitting parts;

a plurality of current switches connected in parallel to the plurality of light emitting parts, respectively, and causing the current to flow through the light emitting parts or bypass the light emitting parts; and a controlling part which receives brightness information corresponding to the plurality of light emitting parts and outputs pulse width modulation signals to the current switches so that emission time of the plurality of light emitting parts is separately adjusted based on the received brightness information, wherein the current switches comprise bypass transistors connected in parallel to the light emitting parts, respectively, for causing the current supplied from the current supplying part to bypass the light emitting parts, wherein the current switches further comprise capacitors connected to the bypass transistors, respectively, and charged with a certain voltage, and the controlling part outputs control signals to turn on the bypass transistors when the capacitors are charged, and the light emitting apparatus further comprises:

a voltage supplying part which supplies a voltage to the capacitors, and the controlling part comprises a capacitor controller for controlling the capacitors to be charged with the certain voltage, wherein the voltage supplying part is connected to first ends of the capacitors and the capacitor controller is connected to second ends of the capacitors, and the capacitor controller determines whether the voltage output from the voltage supplying part is supplied to the first ends of the capacitors in order to control charging of the capacitors, wherein the current switches comprise turn-on voltage transmitting parts which supply a turn-on voltage to the bypass transistors according to the control signals from the controlling part in a state where the capacitors are charged, wherein each of the turn-on voltage transmitting parts comprises at least one of a photo-coupler and a side gate driver.

12. A method of controlling a light emitting apparatus, comprising:

receiving brightness information corresponding to a plurality of light emitting parts connected in series;

supplying current to the plurality of light emitting parts;

outputting pulse width modulation signals to a plurality of switches connected in parallel to the plurality of the light emitting parts, respectively, so that emission times of the plurality of light emitting parts are separately adjusted based on the received brightness information;

causing the current to flow through the light emitting parts or bypass the light emitting parts via the plurality of the switches according to the pulse width modulation signals selectively connecting a plurality of bootstrap capacitors to the plurality of the switches, respectively;

controlling respective connections between the plurality of the bootstrap capacitors and the plurality of the switches based on the output pulse width modulation signals;

controlling the bootstrap capacitors to be charged with a certain voltage; and supplying the certain voltage of at least one of the plurality of the bootstrap capacitors to turn on a corresponding switch among the plurality of the switches when the at least one of the plurality of the bootstrap capacitors is selectively connected to the corresponding switch based on a pulse width modulation signal, from among the pulse with modulation signals, output to the corresponding switch.

13. The control method according to claim 12, wherein the causing the current to flow through the light emitting parts or bypass the light emitting parts comprises switching flow of the current so that the current flows through the light emitting parts or bypasses the light emitting parts according to the pulse width modulation signals.

14. The control method according to claim 13, wherein the causing the current to flow through the light emitting parts or bypass the light emitting parts further comprises switching flow of the current by a voltage signal different from the pulse width modulation signals according to the pulse width modulation signals.

15. A method of controlling a light emitting apparatus, comprising:

receiving brightness information corresponding to a plurality of light emitting parts connected in series;

supplying current to the plurality of light emitting parts;

outputting pulse width modulation signals so that emission times of the plurality of light emitting parts are separately adjusted based on the received brightness information; and causing the current to flow through the light emitting parts or bypass the light emitting parts according to the pulse width modulation signals, wherein the supplying the current comprises supplying the current to the plurality of the light emitting parts via a plurality of current switches connected in parallel to the light emitting parts, wherein the plurality of the current switches comprise bypass transistors connected in parallel to the light emitting parts, respectively, for causing the current to bypass the light emitting parts, and capacitors connected to the bypass transistors, respectively, wherein the control method further comprises:

charging, using a voltage supplying part that outputs a voltage, the capacitors with a certain voltage; and outputting control signals to turn on the bypass transistors in response to the charging;

controlling, using a capacitor controller, the capacitors to be charged with the certain voltage, wherein the voltage supplying part is connected to first ends of the capacitors and the capacitor controller is connected to second ends of the capacitors, and determining, using the capacitor controller, whether the voltage output from the voltage supplying part is supplied to the first ends of the capacitors in order to control the charging of the capacitors.

* * * * *